United States Patent [19]

Nakahata

[11] Patent Number: 4,465,359

[45] Date of Patent: Aug. 14, 1984

[54] PORTABLE ELECTROPHOTOGRAPHIC COPYING APPARATUS

[75] Inventor: Kimio Nakahata, Kawasaki, Japan

[73] Assignee: Canon Kabushiki Kaisha, Tokyo, Japan

[21] Appl. No.: 398,364

[22] Filed: Jul. 14, 1982

[30] Foreign Application Priority Data

Jul. 20, 1981 [JP] Japan ..... 56-114073
Jan. 29, 1982 [JP] Japan ..... 57-13080

[51] Int. Cl.[3] ..... G03G 15/00
[52] U.S. Cl. ..... 355/3 R; 355/3 DD; 355/8
[58] Field of Search ..... 355/3 R, 3 DD, 11, 133, 355/8

[56] References Cited

U.S. PATENT DOCUMENTS 3,981,272 9/1976 Smith et al. ..... 355/3 DD

*Primary Examiner*—R. L. Moses
*Attorney, Agent, or Firm*—Fitzpatrick, Cella, Harper & Scinto

[57] ABSTRACT

An image formation apparatus has an image bearing member, a process device for forming an image thereon, a developing device provided with a container having an opening opposed to the image bearing member and containing a magnetic developer therein, a developing roller for supplying the magnetic developer to the image bearing member, a magnetic field generating member for generating a magnetic field in the gap formed by the opening and the developing roller, and a grip provided on the opposite side of the apparatus from the image bearing member with respect to the opening to make the apparatus portable.

11 Claims, 9 Drawing Figures

PORTABLE ELECTROPHOTOGRAPHIC COPYING APPARATUS

BACKGROUND OF THE INVENTION

1. Field of the Invention

This invention relates to an image formation apparatus such as a printer, an electrophotographic copying apparatus or a facsimile, and more particularly a portable image formation apparatus.

2. Description of the Prior Art

In recent years, the demand for a copying apparatus or a facsimile apparatus utilizing the electrophotographic method has been increasing. This is considered to be attributable to the fact that along with the advance of the image recording technique, parts or elements of the apparatus such as photosensitive drums, developing devices, fixing devices, recording means, etc. have been improved and the compactness of the apparatus has been increased without harming the performance thereof. Thus, the space required for installing the apparatus has become smaller. The reduced cost of the apparatus has made it possible for the user to buy several of these devices. As the compactness of the apparatus increases, the weight of the apparatus body is reduced and, the occasion for carrying the device with one hand like an attaché case increases.

However, where the means in the apparatus body for developing electrostatic or magnetic latent images uses powdered toner, there is a possibility of the toner being spilt out of the developing device depending on the condition in which the apparatus body is carried.

For example, if the electrophotographic apparatus as disclosed in U.S. Pat. No. 4,223,993 is to be carried, it will be necessary to carefully balance the apparatus and, in some cases, the developer in the developing device or the cleaning device may flow out of the devices to contaminate the interior as well as the exterior of the apparatus.

SUMMARY OF THE INVENTION

It is an object of the present invention to provide an image formation apparatus best suited for carrying.

It is another object of the present invention to provide an image formation apparatus in which developer is prevented from being spilt from the developer containing portion of the apparatus when the apparatus is carried.

It is still another object of the present invention to provide an image formation apparatus which can be stably carried.

To achieve such objects, the image formation apparatus of the present invention has a latent image bearing member, latent image formation means for forming a latent image on the latent image bearing member, a developing means provided with a container having an opening opposed to the latent image bearing member and containing a magnetic developer therein and a developing roller for supplying the magnetic developer to the latent image bearing member, a magnetic field generating member for generating a magnetic field in a gap defined by the opening and the developing roller, and a grip provided on the opposite side to the latent image bearing member as viewed from the opening to enable the image formation apparatus to be carried.

According to the present invention, there is also provided an image formation apparatus having a latent image bearing member, latent image formation means for forming a latent image on the latent image bearing member, a developing means provided with a container having an opening opposed to the latent image bearing member and containing a magnetic developer therein and a developing roller for supplying the magnetic developer to the latent image bearing member, a magnetic field generating member for generating a magnetic field in a gap defined by the opening and the developing roller, a transfer means for transferring the developed image on the latent image bearing member onto a transfer medium, fixing means for fixing the developed image transferred onto the transfer medium, and a grip provided to enable the image formation apparatus to be carried, the fixing means being provided farther from the grip than the latent image formation means and the developing means.

According to the present invention, there is further provided an image formation apparatus having a latent image bearing member, a latent image formation means for forming a latent image on the latent image bearing member, a developing means for developing the latent image, a cleaning means for removing and collecting a magnetic developer remaining on the latent image bearing member into a container having an opening opposed to the latent image bearing member, a magnetic field generating member provided at a position different from the opening side, and a grip provided on the latent image bearing member side as viewed from the opening to enable the image formation apparatus to be carried.

The invention will become more fully apparent from the following detailed description thereof taken in conjunction with the accompanying drawings.

DESCRIPTION OF THE PREFERRED EMBODIMENTS

The present invention will hereinafter be described with respect to an embodiment of a copying apparatus to which the electrophotographic method is applied.

Figure 1A:
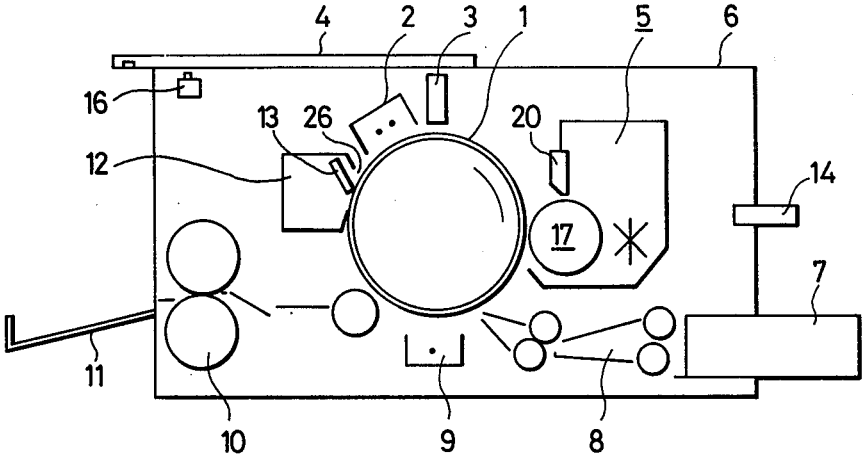
FIG. 1A is a cross-sectional view of major portions of a copying apparatus showing an embodiment of the present invention.
Figure 1B:
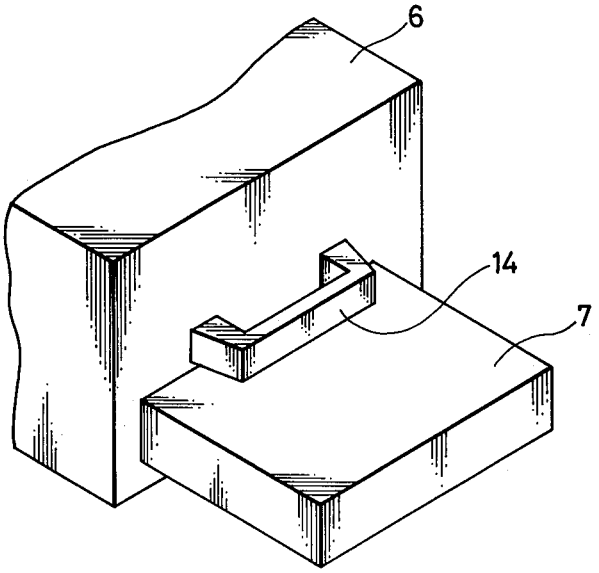
FIG. 1B is a perspective view of the grip portion of the copying apparatus of FIG. 1A.

Referring to FIG. 1 which shows a cross-section of the major portions of a copying apparatus, a drum-shaped photosensitive medium 1 has a photosensitive layer of Se, $ZnO_2$, OPC or amorphous silicon provided on the surface thereof. The photosensitive drum 1 is activated by being subjected to a corona discharge of a polarity suitable for the characteristic of the photosensitive layer by a charger 2, and then the image of an original on a movable original carriage 4 is projected upon the photosensitive drum 1 through a fixed bar lens 3, whereby an electrostatic latent image is formed on the surface of the photosensitive drum. This latent image is developed into a visible image by a developing device 5 with the aid of toner charged to the polarity opposite to the polarity of the latent image. The visible image is transferred onto a transfer paper by a transfer charger 9, the transfer paper being fed to the photosensitive drum from a paper supply cassette 7 removably mounted on the copying apparatus body 6 through a feeding path 8. Thereafter, the image on the transfer paper is fixed by fixing means 10 such as a pair of pressure rollers or heat rollers, and then the transfer paper is discharged as a finished copy onto a paper discharge tray 11. The paper discharge tray 11 is removably and projectedly provided on a side wall of the copying apparatus and may be removed from the apparatus body when the copying apparatus 6 is carried. After image transfer, any toner remaining on the drum 1 is removed therefrom by the blade 13 of a cleaning device 12 and collected in the container of the cleaning device 12.

A carrying grip 14 as shown in FIG. 1A is provided on a side wall of the copying apparatus 6 which wall is adjacent to a developing roller 17 as viewed from the drum 1. Accordingly, if one holds up the grip 14, one can carry the copying apparatus 6. Not only in a copying apparatus of the movable original carriage type such as in the present embodiment but also in a copying apparatus of the movable optical exposure system type, a construction can be adopted in which when the copying apparatus is carried, the original carriage or the exposure optical system is automatically or manually locked at a home position (FIG. 3) by a plunger 16 or some other locking mechanism. For example, if the locking means is designed to operate after a series of copying operations, the user need not confirm that the lock is engaged each time he carries the copying apparatus.

Figure 2:
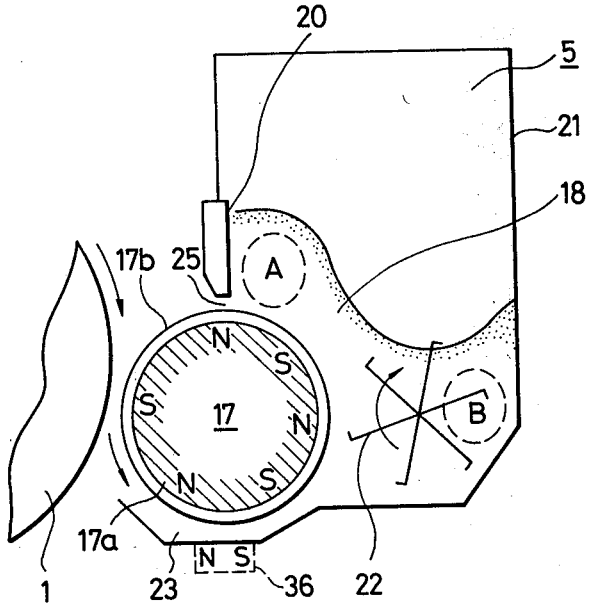
FIG. 2 is a cross-sectional view of a developing device for one-component magnetic toner shown in FIG. 1.

FIG. 2 is a cross-sectional view of the developing device 5 used in the apparatus of FIG. 1. Below a container 21 provided across the width of the drum 1, a developing roller 17 is disposed in an opposed relationship with the drum. The developing roller 17 comprises a rotatable non-magnetic sleeve 17*b* and a stationary magnet roller 17*a* disposed within the sleeve 17 and provided with a plurality of magnetic poles. Magnetic toner adhering to the sleeve 17*b* is supplied from the container 21 to the drum 1 through an opening 25 by relative rotation of the sleeve 17*b* and the magnet roller 17*a* while having its thickness controlled by a magnetic blade 20. The magnetic toner after so controlled frictionally slides on the drum 1 thereby to visualize the latent image.

Of the toner 18 in the container 21, the toner in the portion A near the magnet roller 17*a* is subjected to a force in a direction tending to cause the toner to be adsorbed to the surface of the sleeve 19 due to the action of the magnetic field. The toner itself exists as a magnetic aggregate and therefore will not move even if it is subjected to the influence of a more or less extraneous force. On the hand, as regards the toner in the portion B near stirring bars 22, even if, for example, only the toner adjacent to the sleeve 17*b* is consumed to create a space adjacent to sleeve 17*b*, toner is rapidly supplied to consumed portion from the this space by the force of gravity to thereby ensure that the toner to be uniformly distributed over the widthwise direction of the developing device 5.

If a grip is provided on a side wall of the copying apparatus body which extends widthwise of the drum and one lifts the copying apparatus body, the developing device, together with the photosensitive drum, will be positioned vertically in the apparatus body and therefore, the toner near the stirring bars 22 in the developing device 5 will flow to form a great heap on one side and in the next copying cycle, it will become impossible to supply the toner uniformly to the sleeve 17*b*. Also, an opening 23 defined by the container 21 adjacent to the stirring bars and the sleeve 17*b* is wider than an opening 25 defined by the blade 20 and the sleeve 17*b* and therefore, if the toner collects excessively toward one side, it will overflow due to its weight and the momentum of its flow.

In the present invention, to solve such problems, the grip is provided at the position indicated in FIG. 1. The effect resulting from the provision of the grip 14 at such position will hereinafter be described with reference to FIGS. 3 to 5.

Figure 3:
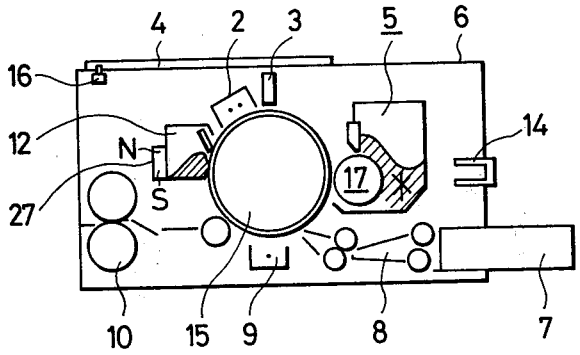
FIGS. 3 to 5 are cross-sectional views of major portions of the copying apparatus illustrating the process in which the copying apparatus body is lifted by the use of the grip thereof.
Figure 4:
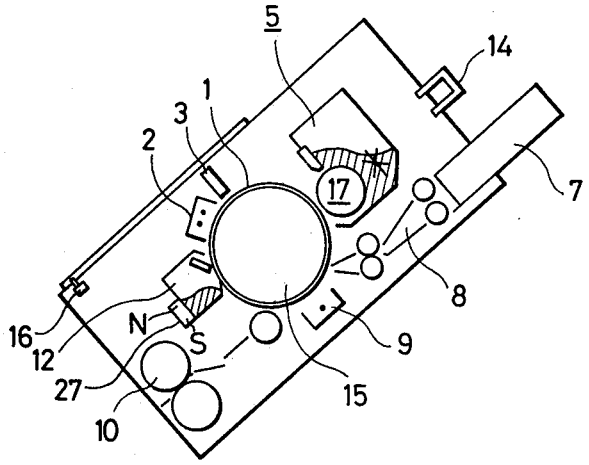
Figure 5:
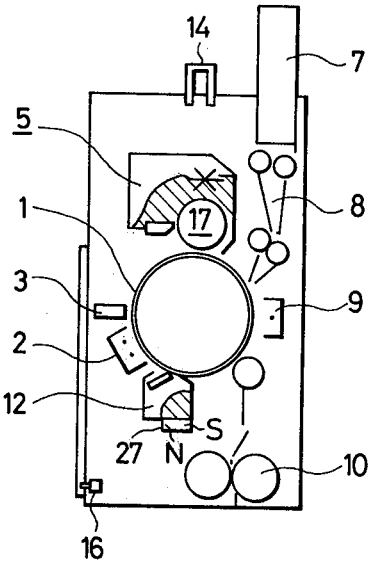

FIGS. 3 to 5 illustrate in cross-section the manner in which the apparatus body 6 is lifted by grasping the grip 14. As the apparatus body 6 becomes inclined with the openings 23 and 25 of the developing device facing downwardly, the toner free from the magnetic field near the stirring bars 22 which occupy the lower portion of the container 21 moves toward the magnet roller 17*a* and toward the upper portion of the container 21 by the force of gravity and is captured by the magnetic field of the magnet roller 17*a*. By this, most of the toner becomes magnetically concentrated and restrained in the container 21. Thus, even during the carrying of the apparatus body, inclination or scattering of toner can be prevented.

On the other hand, the cleaning device 12 disposed in opposed relationship with the developing device 5 with the drum 1 interposed therebetween receives the toner scraped by the cleaning blade 13, through an opening 26 opposed to the drum 1. A magnetic member 27 such as a magnet is provided in proximity to or in contact with the container of the cleaning device. As a result, as the grip 14 is lifted, the toner in the cleaning device 12 can be concentrated and restrained by the magnetic force, whereby scattering of the toner from the container of the cleaning device can be prevented and further, the collection efficiency of toner can be improved. The magnetic member 27 of the cleaning device 12 may be provided as required, and in a cleaning device 12 wherein the entire lower portion thereof provides a container wall when the apparatus body is lifted, scattering of toner can be prevented without such magnetic member 27.

Figure 6:
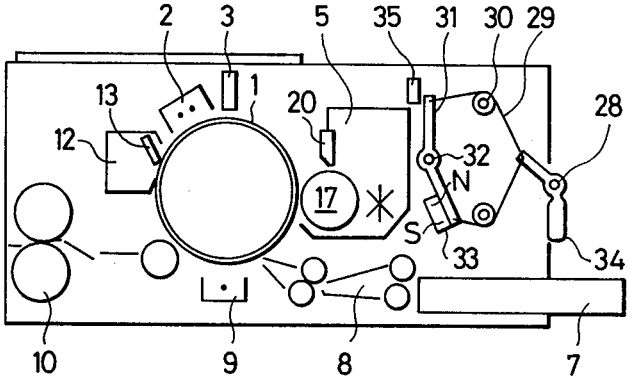
FIGS. 6 and 7 are cross-sectional views of an embodiment further improved in the prevention of the outflow of toner from the bottom side of the container of the developing device when the apparatus is being carried.

FIG. 6 shows an embodiment improved in the prevention of the outflow of toner from the bottom side of the container of the developing device 5 during the carrying of the apparatus.

Figure 7:
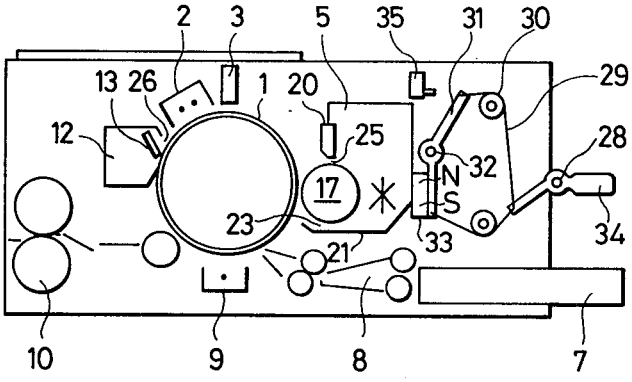

In this embodiment, a grip 34 is rotatably mounted at the indicated position and provided along a side wall so that it is not in the way as shown in FIG. 6 when the apparatus is not being carried. When the apparatus to be carried, the grip 34 may be rotated through 90° relative to the apparatus body and cocked up as shown in FIG. 7. By this rotating operation, the grip 34 is rotated about a pivot 28 to thereby greatly move the opposite end of the grip 34. This opposite end is engaged with wire 29, which rotates an arm 31 about a pivot 32 througn the intermediary of a pulley 30. A magnet 33 is attached to the lower end of the arm 31. The magnet 33 contacts the lower portion of the developing device 5 only during the carrying of the apparatus, as shown in FIG. 7.

The above-described construction enables the magnetic field by the magnet 33 to act on the toner in the lower portion of the developing device 5 from which the toner has been liable to be spilt and thereby hold the toner satisfactorily, and thus the toner is not spilt due to more or less vibration or shock.

Designated by 35 in FIGS. 6 and 7 is a microswitch which detects the position of the arm 31 to enable it to be confirmed that the magnet 33 is at a proper position. That is, if the developing device is operated with the magnet 33 remaining in the position of FIG. 7, sufficient movement of the toner in the container will become impossible and development may become impossible. For this reason, if the microswitch 35 is operatively associated with the switch of the power source portion of the apparatus body so that when the grip 34 is held up, the copying operation is stopped and that the power source is not connected when the handle is in the position shown in FIG. 7. Thus, the problem attributable to the contact of magnet 33 with the lower portion of developing device 5 will not occur. Thus, the openings 23 and 25 in the container 21 and the magnet roller 17*a* can be closed by the action of the magnetic field by the magnet roller 17*a* on the toner in the openings, thereby preventing outflow of the toner. According to this construction, even if the cleaning device 12 is a simple box, no problem will occur if the opening 26 for collecting the toner is provided on the grip 34 side.

Figure 8:
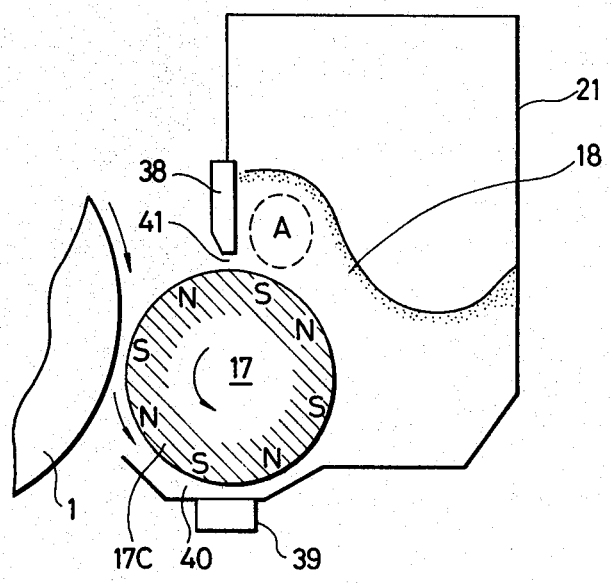
FIG. 8 is a cross-sectional view of a developing device for a two-component magnetic toner containing magnetic carrier particles and toner.

As a developing device for carrying out the present invention satisfactorily, a construction in which a developing roller is disposed at the lower part and a toner reservoir is provided at the upper part is preferred. The openings 23 and 25 which are defined by the developing container and the developing roller as the result of the rotation of the developing roller should preferably be narrow. To better prevent the toner from being spilt from these openings, a magnetic field concentrating in these openings may be formed and, for example, as shown in FIG. 2, the magnetic blade 20 may be opposed to the magnetic poles or a magnet 36 indicated by a broken line in FIG. 2 may be disposed near the opening 23. In the developing device 5 of the above-described construction, the toner can move to the upper portion of the developing roller 17 when the apparatus is carried, whereby the toner can be prevented from concentrating in the lower portion of the developer 5 which has a wide opening. Although this description has been limited to one-component magnetic toner, the present invention is of course applicable to a two-component magnetic brush developing device containing a magnetic carrier such as powdered Fe, as shown in FIG. 8. The magnet roller 17*c* is rotatable counter-clockwise and magnetic members 38 and 39 are provided in openings 40 and 41. This embodiment is suitable in a case where the container 21 is non-magnetic.

As already described, the paper discharge tray 11 is removably mounted on the copying apparatus body, and if the dismounted paper discharge tray 11 is contained in a containing portion provided in the apparatus body (for example, a pocket or the like provided in the side wall or the upper portion of the copying apparatus) or contained in the apparatus body, it will be convenient both when the apparatus is carried out when the apparatus is placed with the paper discharge tray side thereof facing downwardly.

Further, the paper supply cassette 7 containing the transfer paper therein is removably inserted with respect to the side wall on which the grip 14 is provided. Accordingly, one can carry the copying apparatus without the risk of the cassette 7 falling off.

The fixing means 10 using pressure rollers is heavier than a fixing means using heat rollers. Accordingly, it is desirable from the viewpoint of the stability with which the apparatus is carried that the fixing means be situated in the lower portion of the apparatus, and this also holds true in a case where the copying apparatus is housed in an upright position without occupying a large space. The construction of the present embodiment satisfies this condition and the apparatus body is stable both when it is carried and when it is placed on a floor or the like with the grip facing upwardly, and thus can be set down without the possibility of falling down.

What I claim is:

1. A portable electrophotographic copying apparatus, comprising:

an electrophotographic photosensitive member;

a latent image forming means including a movable optical scanning member for scanning an original to form a latent image corresponding to the original on said photosensitive member;

developing means provided with a container having an opening opposed to said photosensitive member for containing magnetic developer therein and magnet means for forming a magnetic field in the opening;

a frame for supporting said photosensitive member, latent image forming means and developing means;

a grip for carrying said apparatus, said grip being provided on said frame on the side of said photosensitive member opposite the opening in said container; and lock means for locking said optical scanning member at a predetermined position for preventing said optical scanning member from moving when said apparatus is being carried.

2. A portable electrophotographic copying apparatus according to claim 1, wherein said developing means comprises a developing roller for supplying magnetic developer to said photosensitive member, said developing roller comprising a non-magnetic cylindrical sleeve, and wherein said magnetic means is a magnetic member provided in said sleeve and has magnetic poles.

3. A portable electrophotographic copying apparatus according to claim 1, wherein said magnetic means has a rotatable member provided with magnetic poles therearound, for supplying the magnetic developer to said photosensitive member and for forming the magnetic field in the opening.

4. A portable electrophotographic copying apparatus according to claim 1, 2 or 3, wherein said apparatus further includes cleaning means opposite to said developing means relative to said photosensitive member, said cleaning means including a removing member for removing the magnetic developer from said photosensitive member and a container having an opening opposed to said photosensitive member for collecting the removed magnetic developer.

5. A portable electrophotographic copying apparatus according to claim 4, wherein said container of said cleaning means has a magnetic member at a side opposite to said opening which is opposed to said photosensitive member.

6. A portable electrophotographic copying apparatus according to claim 1, 2 or 3, wherein said container of said developing means has at its bottom portion a magnetic member for producing a magnetic field in a gap formed by said developing roller and said container.

7. A portable electrophotographic copying apparatus according to claim 1, wherein said grip is rotatably supported at a side of said frame for movement between a first position when said apparatus is being carried and a second position when said apparatus is not being carried, said grip being provided with an interlocking magnetic member which is brought into contact with the lower portion of said container of said developing means by the rotation of said grip to the second position.

8. A portable electrophotographic copying apparatus according to claim 7, further comprising a detecting means for detecting said first and second positions of said grip and interlocking magnetic member, and means for disconnecting electrical power to said apparatus in response to a signal from said detecting means when said grip and interlocking magnetic member are in said first position.

9. A portable electrophotographic copying apparatus, comprising:

an electrophotographic photosensitive member;

latent image forming means having a movable optical scanning member for scanning an original to form a latent image corresponding to the original on said photosensitive member;

developing means for developing the latent image;

a frame for supporting said photosensitive member, latent image forming means and developing means;

a grip provided at a side of said frame for carrying said apparatus; and lock means for locking said optical scanning member at a predetermined position for preventing said optical scanning member from moving when said apparatus is being carried.

10. A portable electrophotographic copying apparatus according to claim 1 or 9, wherein said lock means is a plunger for locking said optical scanning member at its home position after a sequence of copying operations is completed.

11. A portable electrophotographic copying apparatus according to claim 1 or 9, wherein said optical scanning member has an original carriage capable of moving an original placed thereon.

* * * * *

UNITED STATES PATENT AND TRADEMARK OFFICE

CERTIFICATE OF CORRECTION

PATENT NO. : 4,465,359

DATED : August 14, 1984

INVENTOR(S) : KIMIO NAKAHATA

It is certified that error appears in the above-identified patent and that said Letters Patent is hereby corrected as shown below:

Column 3, line 63, "On the hand" should read --On the other hand--;
line 67, delete "consumed portion from the";
line 68, "to be" should be --is--.

Column 4, line 68, "througn" should be --through--.

Column 5, line 42, "concentrating" should read --concentrated--.

Signed and Sealed this

*Eleventh* Day of *June 1985*

[SEAL]

*Attest:*

DONALD J. QUIGG

*Attesting Officer* *Acting Commissioner of Patents and Trademarks*